US007146839B2

(12) United States Patent
Goop

(10) Patent No.: US 7,146,839 B2
(45) Date of Patent: Dec. 12, 2006

(54) PRESS TOOL

(75) Inventor: Hans-Joerg Goop, Schellenberg (LI)

(73) Assignee: Ridge Tool Company, Elyria, OH (US)

( * ) Notice: Subject to any disclaimer, the term of this patent is extended or adjusted under 35 U.S.C. 154(b) by 72 days.

(21) Appl. No.: 10/986,164

(22) Filed: Nov. 12, 2004

(65) Prior Publication Data

US 2005/0145005 A1 Jul. 7, 2005

(30) Foreign Application Priority Data

Nov. 13, 2003 (EP) ..... 03025943

(51) Int. Cl.
*B21D 37/10* (2006.01)

(52) U.S. Cl. ..... 72/416; 72/465.1

(58) Field of Classification Search ..... 72/416, 72/412, 54; 29/237, 282, 283.5
See application file for complete search history.

(56) References Cited

U.S. PATENT DOCUMENTS 6,434,998 B1 * 8/2002 Amherd ..... 72/416
2001/0000564 A1 * 5/2001 Bowling ..... 72/416
2001/0006001 A1 7/2001 Battenfeld

FOREIGN PATENT DOCUMENTS

| | | |
|---|---|---|
| DE | 93 14 054 U | 1/1994 |
| EP | 1 095 739 A | 5/2001 |
| EP | 1 114 698 A | 7/2001 |

* cited by examiner

*Primary Examiner*—Lowell A. Larson
*Assistant Examiner*—Debra Wolfe
(74) *Attorney, Agent, or Firm*—Rothwell, Figg, Ernst & Manbeck, P.C.

(57) ABSTRACT

A press tool for pressing a receiving part of a fitting onto a pipe is provided. The press tool includes two elastically-deformable press elements, each having a first end, a pressing region, assigned to the sealing section, having an inner shape that at least partially departs from a constant curvature in a circumferential direction, and a second end having a force input region and a stop surface. A hinge couples the press elements together at the first end of each press element. When the press tool is closed, the stop surfaces of the press elements abut one another, and when the press tool is closed and a pressing force is applied to the force input regions of the press elements, the press elements elastically deform such that the inner shapes of the pressing regions are substantially constantly curved in the circumferential direction.

11 Claims, 2 Drawing Sheets

PRESS TOOL

FIELD OF THE INVENTION

The invention relates to a press tool for pressing a receiving part of an installation element onto a pipe pushed into the receiving part, the receiving part pressed on having a section with an outer shape curved constantly in the circumferential direction and within a predetermined shape tolerance.

BACKGROUND OF THE ART

For joining of an installation element—for example of a fitting or of a connecting piece—to a pipe by coldforming, the press tool is placed around a receiving part of the installation element. Drive forces are introduced into the press tool via a drive device, with the result that compressive forces are exerted by the press tool on the receiving part into which the pipe has been inserted. As a result of the compressive forces, the receiving part is formed in such a way that the receiving part is nondetachably joined to the inserted pipe by being pressed on.

As a rule, in addition to at least one press-on section for transmitting longitudinal and torsional forces, a receiving part also has a sealing section for sealing the joint, with the result that such a receiving part can be pressed onto a pipe to form a seal. In the case of joints of relatively small nominal diameters DN (Deutsche Norm [German standard]), a narrow impression region having a polygonal base shape is provided for mechanical securing of the joint.

The sealing of the joint between pipe and installation element is achieved, as a rule, by means of a gasket which faces the pipe and is arranged on the inside of the sealing section of the receiving part. For secure and reliable sealing, firstly an elastic compressive stress of the gasket, distributed uniformly all round, against the pipe and against the receiving part and, secondly, avoidance of crushing of the gasket are absolutely essential. Such a uniform compressive stress can be achieved only if, when the receiving part is being pressed on, the sealing section is formed uniformly all round within a very specific circumference. Manufacturers of such installation elements therefore specify shape tolerances predetermined in a type-specific manner, for example roundness or cylindrical tolerances, for pressed-on receiving parts. The shape tolerances relate in particular to the respective outer shape of the sealing region or optionally also of the entire press-on region.

Inter alia, scissors-like jointing clamps which open in a mouth-like manner at one end and are firmly connected to a drive device at the other end are known in practice for pressing pipe joints having nominal diameters DN up to 54 mm to give a seal. For larger nominal diameters DN, as a rule press chains or even press rings are used which have to be uncoupled from the coordinated drive device each time they are placed on an installation element to be pressed on.

DE 93 14 054 U1 discloses a jointing clamp for pressing pipe joints. The jointing clamp has two press levers, at one end of each of which a substantially rigid press jaw is provided and which in each case are mounted by means of an axle so as to be pivotable in opposite directions on connecting plates. When the tool is in the closed state, a substantially cylindrical press shape which is incorporated into the pressed object during pressing is formed by the two press jaws. Owing to the given dimensions of such jointing clamps, it has been found in practice that the handling is inconvenient where space is limited, in particular in the production of pipelines for household installations, and is often not possible at all in the case of preinstalled fittings close to the wall or close to the floor. In addition, particularly close to the floor, there is the danger that small objects or building site rubble may prevent complete closing of the jointing clamps, which may result in malfunction of the pipe joint. Since, in addition, the end pieces of the jointing clamp which open in a mouth-like manner can be seen only with difficulty by the operator, jointing clamps in which a special device for monitoring for complete closing of the two press jaws is provided are known.

BRIEF SUMMARY OF THE INVENTION

It is an object of the invention to eliminate deficiencies of the prior art and to provide a press tool which safely and reliably permits pressing of an installation element onto a pipe to give a seal, even at small distances from wall and floor surfaces.

Further alternative or advantageous developments and further developments of the invention are described herein.

A press tool for pressing a receiving part of an installation element onto a pipe inserted into the receiving part has two press elements which are connected so as to be movable relative to one another. The receiving part has at least one section which is formed by the press-on process in such a way that the pressed-on section has an outer shape which is curved substantially constantly in the circumferential direction and is within a predetermined shape tolerance, for example a roundness tolerance or a cylindrical tolerance. Each of the two press elements has, on the side facing the respective other press element, a press region which is coordinated with the section.

When the press tool is in the opened state, at least two coordinated end pieces of the press elements are far enough away from one another that the press tool can be pushed over the receiving part and placed on the receiving part. For pressing on the receiving part, drive forces, by means of which the end pieces are moved towards one another, are introduced into the tool. As a result of the press elements resting against the receiving part being moved towards one another, the receiving part is pressed onto the pipe with coldforming. The press-on process is complete when the end pieces coordinated with one another abut one another—the press tool travels to the blocking position—and are thus in the closed state.

According to the invention, at least one of the two press elements is elastically deformable, in particular elastically bendable, in such a way that, under the forces acting on the press element and changing during the press-on process, the shape of its pressing region changes. The pressing region which is exposed in the stationary state of the press tool is present in the circumferential direction in a shape curved differently compared with the outer shape. On the other hand, the same pressing region is present in the circumferential direction in a substantially constantly curved shape corresponding to the outer shape if the pressing region rests against the section when the closed press tool is in the pressing state.

It is known that installation elements and pipes are manufactured from materials which spring back more or less elastically after a plastic deformation. When the closed press tool is in the pressing state, the pressing region adjacent to the section therefore does not have the identical curvature but a correspondingly slightly stronger, substantially constant curvature. This prevents the outer shape of the section from being outside the shape tolerance after the end of the press-on process.

A press element according to the invention is no longer formed so as to be virtually rigid but is elastically deformable under loads which act on the press element during pressing. The elastic deformations, which are caused by the drive forces, by forces exerted by the connection of the two press elements and by forces exerted by the receiving part to be pressed onto the press element, are taken into account specifically in the design of the press element, in particular in the shaping of the pressing region. For this reason, the curvature of the pressing region exposed in the stationary state also differs from the constant curvature of the required outer shape of the pressed-on section. Since, in a press element according to the invention, elastic deformations are intended instead of high rigidity, it is possible to provide smaller, slimmer and lighter press tools, by means of which receiving parts can be pressed onto pipes whose sections are reproducibly within the required shape tolerance.

A variable shape of the pressing region during the press-on process additionally offers possibilities of independently and specifically influencing the press-on process. If, when the receiving part is being pressed on, the sum of the formability required for pressing on and of the work required for the elastic deformation of the press element is distributed as uniformly as possible over the distance covered by the drive forces during pressing on, any resultant peak values of the drive forces can be reduced in a targeted manner. On the one hand, the durability and long-term dimensional stability of press tools can be positively influenced thereby. Advantages in the dimensioning of such press tools are also associated therewith. On the other hand, such press tools can also be operated with a less powerful drive device.

In the case of elastically deformable press tools, there is a direct interdependence between the dimensioning of the press element and the shaping of the pressing region. The shape for such an elastically deformable press element can be obtained either by complicated calculations or by iterative testing and correction of the respective press element, in particular of its pressing region. Thus, a start of the press-on process in regions parallel to the closing plane of the press tool through the central part of the pressing region and subsequent bending together of the press element, which initiates forming by the two edge parts of the pressing region, have proved to be a sequence of individual forming steps which achieves the object. By stepwise correction of the shape of the pressing region by a part of the determined deviations from the required outer shape of the pressing region after the section has been pressed on, the definitive shape of the press region can be determined.

Advantageously, both press elements of a press tool are formed in the same manner, elastically deformable according to the invention, so that the pressing regions thereof when the tools are in the closed state assume a shape corresponding to the required outer shape only under the mechanical loads occurring during pressing on.

In a preferred embodiment of the invention, both press elements are formed so as to be sickle-shaped and are hinged to one another at one end by means of a single bearing pin. At the other end, both press elements have an end piece with in each case a force input region and a stop surface for blocking of the tool travel. This embodiment is distinguished by a simple design and by a precisely guided movement of the two elastically bendable press elements.

In addition to a constantly curved section for a sealing element, a receiving part of an installation element has, as a rule, a further section for nondetachable joining of the installation element to a pipe. For example, in the case of receiving parts of relatively small nominal diameters, a further impression region which is shaped into a hexagon is often provided. For medium and large nominal diameters, such a further section for nondetachable joining often also has a constant curvature, optionally with a cylindrical shape, in the pressed-on state. A corresponding press element has a further pressing region coordinated with the further section, in the shaping of which pressing region the elastic deformation of the press element should likewise be taken into account.

In the case of a hinged press tool having sickle-like press elements, a simple embodiment envisages the respective pressing regions will be formed by a plurality of segments which are arranged in series and which have in each case a constant curvature in the circumferential direction and are arranged in series tangentially, with the result that their centres of curvature are a distance apart. In the case of such a press tool, in the stationary, closed state of the exposed pressing regions, a rest shape is formed which differs from the outer shape and whose internal diameter perpendicular to the closing plane of the press tool is smaller than its internal diameter substantially parallel to the closing plane.

BRIEF DESCRIPTION OF THE SEVERAL VIEWS OF THE DRAWINGS

Embodiments of the invention are explained in more detail below with reference to figures.

DETAILED DESCRIPTION OF THE INVENTION

Figure 1:
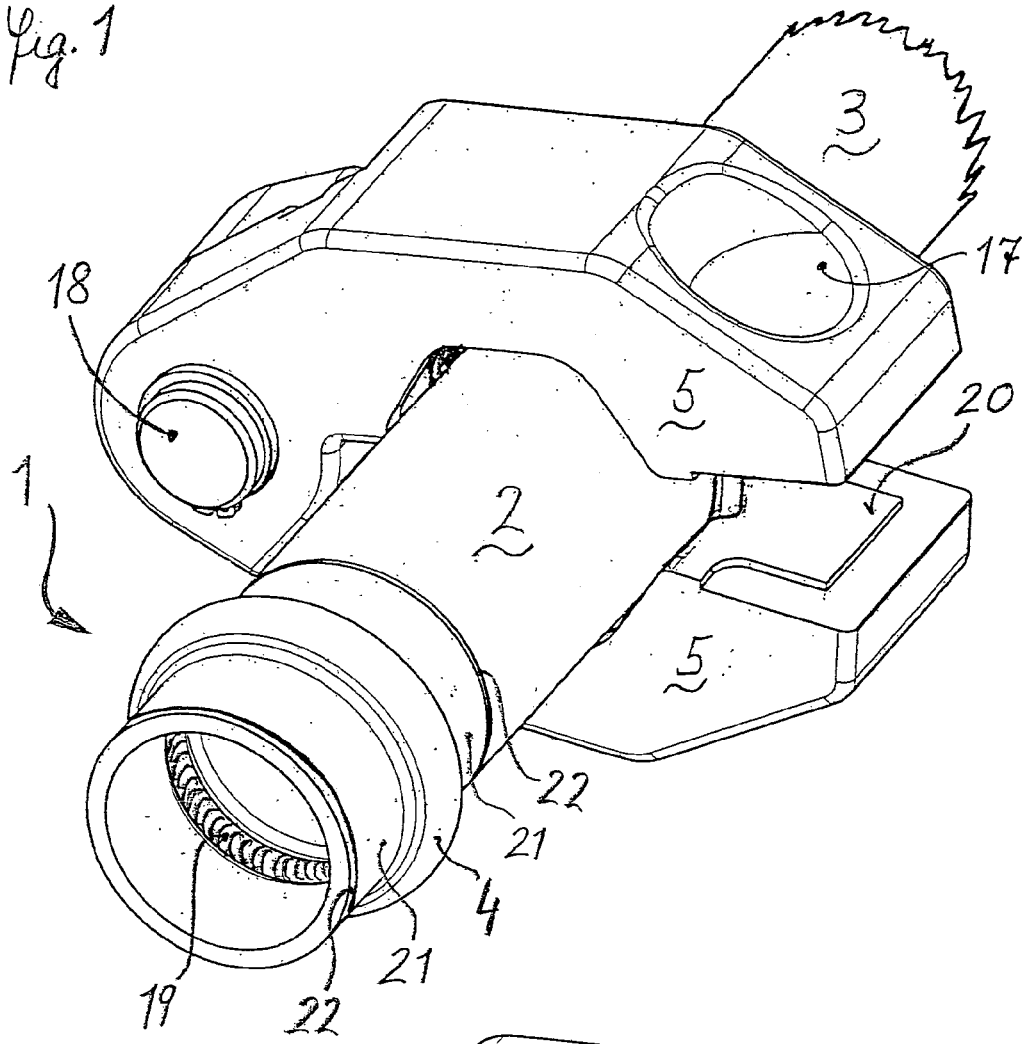
FIG. 1 shows an oblique view of a press tool according to the invention, which, in the pressing state, is pressing a fitting onto a pipe.

FIG. 1 shows an installation element which is in the form of a fitting 2 and into one end of which a pipe 3 is inserted, and an embodiment of a press tool according to the invention, which is placed against the fitting 2, in an oblique view.

The press tool shown here has two press elements 5, which are identically formed here and have an elongated sickle-like basic shape. A force input region 17 and a stop surface 20 are provided at one end of each of the two press elements 5. A tension jaw, which in turn is connected to a drive device, may be applied to the two force input regions 17. Two drive forces are exerted on the press tool by the tension jaw for pressing the fitting 2 onto the pipe 3. At the other end, the two press elements 5 are hinged to one another by means of a common bearing pin 18.

The fitting 2 shown here is a KIWA-DVGW copper fitting of nominal diameter DN 18 from system supplier "Viega, Franz Viegner II, D-57428 Attendorn". The fitting 2, has at both ends, a receiving part 1 which is formed here in each case for a pipe 3 of the same nominal diameter. The pipe 3, for example a copper pipe having a wall thickness of one and a half millimeters, is inserted at one end in the fitting 2 up to a stop provided in said fitting.

That receiving part 1 of the fitting 2 which is visible in FIG. 1 is in the initial state where it has not been pressed on and thus has a rotationally symmetrical basic shape. When the receiving part 1 has not been pressed on, a pipe 3 has not yet been inserted. The receiving part 1 has a sealing section 4, which in this case is a bulge in the form of half a torus, two press-on sections 21, which are arranged on both sides of the sealing section 4, and two impression sections 22, which in each case are arranged adjacent to one of the press-on sections. The sealing section 4 has, on its inside, an all-round bulge which is likewise toroidal and in which a gasket 19, shown here only in part, is provided.

The other receiving part—for the most part concealed in FIG. 1 by the applied tool—is in the initial state before being pressed on. The press tool grips almost completely around the other receiving part and rests against it. As a result of the drive forces, the press tool can be brought into the pressing state. The two drive forces are exerted on the force input regions 17 by a tension jaw which is applied to the tool and is not shown in FIG. 1.

By means of the two drive forces, which in this embodiment may have, for example, a magnitude of 60,000 to 65,000 Newton, the two press elements 5 are moved towards one another until the two hinged end pieces of the press elements 5 abut one another with their stop surfaces 20.

Due to the two press elements 5 moving towards one another, forming forces are exerted extensively over the receiving part 1 to be pressed on, with the result that said part is formed by plastic deformation and is pressed onto the pipe 3 so that it is nondetachable. Owing to the mechanical loads acting on the tool during forming of the other receiving part, the two press elements 5 are elastically deformed since—in comparison with the substantially rigid press jaws of a conventional jointing clamp—they have substantial, elastic flexibility under the resultant loads, owing to their dimensioning. The extent and the form of the elastic deformation of the respective press element 5 are determined by its rigidity, the drive force introduced at one end, the force exerted at the other end by the common bearing pin 18 and the forces with which the receiving part to be pressed on resists the forming.

The two press-on sections 21 and the two impression sections 22 are formed here to give a cylindrical or hexagonal shape, respectively, during pressing on by the press tool. The press-on sections 21 form a frictional connection, and the impression sections 22 an interlocking connection, with the pipe 3. By means of the hexagon impressed into the fitting 2 and the pipe 3, joints of small nominal diameters DN are generally prevented from being pulled apart by small and medium tensile forces. In the case of larger nominal diameters DN, a cutting ring secures the joint with respect to larger tensile forces, said cutting ring being arranged as a rule between a fitting and a pipe inserted into said fitting. A receiving part of such a fitting has a securing region which is arranged around the cutting ring and is formed during pressing on in an outer shape within a predetermined cylindrical tolerance and thus exerts a specified compressive force on the cutting ring.

On the other hand, when the fitting 2 is being pressed onto the pipe 3, the toroidal bulge of the sealing section 4 is formed toroidally in such a way that the gasket 19 is elastically deformed in a controlled manner between the pipe 3 and the bulge and is thus prestressed to a defined extent. The elastically prestressed gasket 19 exerts compressive stresses on the pipe 3 on the one hand and on the bulge on the other hand. The compressive stresses exerted by the gasket 19 are of very decisive importance for the tightness of the joint.

When the two stop surfaces 20 of the press elements 5, driven by the drive forces, are caused to abut one another—the press tool travels to the blocking position—the press-on process is complete and the fittings 2 are joined nondetachably and with a seal to the pipe 3 via the pressed-on receiving part 1.

The quality and the reliability of the joint between an installation element and a pipe can be assessed in a manner known per se through the dimensions of the outer shape of the pressed-on receiving part 1. If the distance across flats of the hexagons which are impressed into the impression regions 22 is within a value range from 23.1 to 23.6 millimeters, a specified pull-apart value for the compression joint is guaranteed by the manufacturer. If the dimensions of the outer shape of the sealing section 4 of the pressed-on receiving part 1 are within a predetermined shape tolerance, the tightness of the joint can be assessed on the basis of the elastic deformations of the gasket 19 and hence on the basis of the compressive stresses exerted on the fitting 2 and the pipe 3 by said gasket. If the outer shape is outside a specified shape tolerance, proper functioning of the installation element is no longer guaranteed by the manufacturer. In this embodiment, for example, a roundness tolerance having a lower and an upper diameter of 24.7 and 25.2 millimeters, respectively, is specified by the manufacturer for the summit region of the toroidal bulge.

Figure 2:
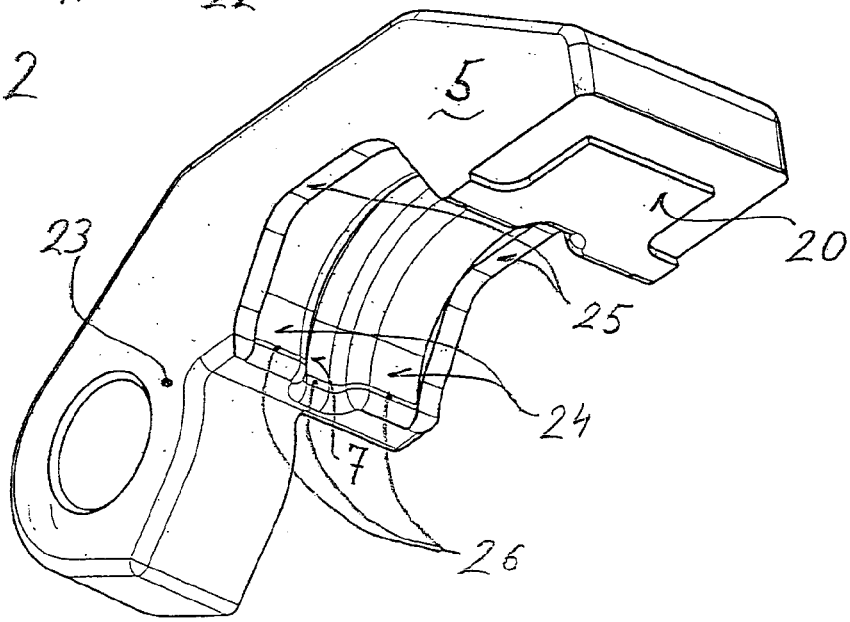
FIG. 2 shows another oblique view of one of the two press elements of the press tool from FIG. 1.

FIG. 2 shows the upper press element 5 of the press tool from FIG. 1 in an other oblique view. The press element 5 has, at one end, the end piece with the stop surface 20 and the force input region 17 visible only in FIG. 1. At the other end, it has a joint part 23 in which a receiving hole for the bearing pin 18 shown only in FIG. 1 is provided. Between the stop surface 20 and the joint part 23, the press element 5 here has, on the side facing the other press element, a toroidal pressing region 7, two cylindrical pressing regions 24 and two hexagonal pressing regions 25, adjacent to both ends of which in each case there is a planar end region 26, which is smaller here. The end regions 26 are formed by additional recesses in the press element 5. Those ends of the end regions 26 which face away from the pressing regions 7 and 24 are each provided with a radius.

Here, the press element 5 is shown in the rest state with exposed pressing regions. A first pressing region 7 can be assigned to the sealing section 4 from FIG. 1 and has a two-dimensionally curved shape which in this case has three different curvatures in the circumferential direction. The two cylindrical pressing regions 24, which in each case can be assigned to one of the press-on sections 21 from FIG. 1, are arranged on both sides of the first pressing region 7. They have a one-dimensionally curved shape, likewise with three different curvatures here. Arranged adjacent to two cylindrical pressing regions 24 are the hexagonal pressing regions 25, which have the conventional shape of half a hexagon and can be assigned to the impression region 22 from FIG. 1. The planar end regions 26 arranged between each of the pressing regions 7 and 24 and the stop surface 20 on the one hand and the joint part 23 on the other hand have different lengths here.

Figure 3:
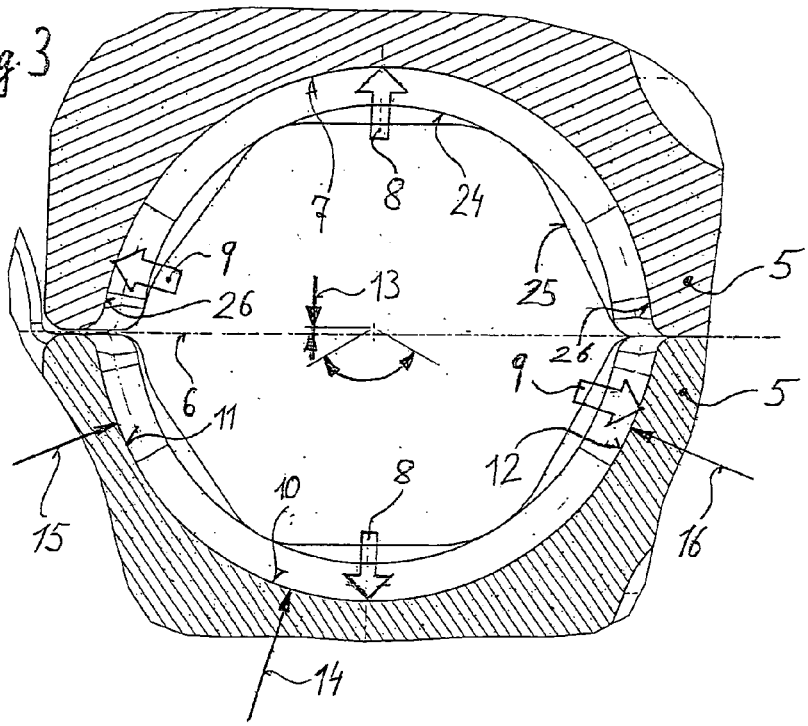
FIG. 3 shows a detailed view of the closed press tool from FIG. 1 in the rest state with the two pressing regions in section and FIG. 4 shows a diagram illustrating the difference between the inner profiles of the same press element in the rest state and in the pressing state of a closed press tool.

FIG. 3 shows a detailed view of the closed press tool from FIG. 1 in the rest state with the exposed pressing regions 7, 24 and 25 and the adjacent end regions 26 in sectional view. The pressing regions 7, 24 and 25 and the respective end regions 26 of the two press elements 5 are arranged in each case with mirror symmetry across the closing plane 6. Since, in the rest state, the tool is not subjected to any mechanical loads, the press elements 5 and their exposed pressing regions 7, 24 and 25 are also not elastically deformed.

The toroidal pressing region 7 is formed here by a central segment 10, a segment 11 on the joint side and a segment 12 on the stop side, which in each case have tangential transitions with one another. The individual segments 10, 11 and 12 each have different curvatures in the circumferential direction. The central segment 10 extends over an angular range of 120° and is thus several times the size of the segment 11 on the joint side and of the segment 12 on the stop side, which extend here over an angular range of about 22° each.

While here the central segment 10 has a central radius 14 of curvature of 12.35 millimeters in the circumferential direction in the summit region of the torus, the segment 11 on the joint side and segment 12 on the stop side have a corresponding radius 15 or 16 of curvature, respectively, of 12.45 or 12.55 millimeters on the joint side and stop side, respectively. In addition, the centre of the central radius 14 of curvature has a centre offset 13 of 0.3 millimeters on each side of the closing plane 6, with the result that—in the rest state of the tool—the banana shape of the toroidal pressing region 7 is additionally reinforced. The centres of the radii 15 and 16 of curvature on the joint side and on the stop side are likewise on each side of the closing plane 6. As a result of this special shape of the two toroidal pressing regions 7, the internal diameter in the opening direction 8 in the case of a closed press tool, i.e. perpendicular to the closing plane 6, is substantially smaller than the internal diameter transverse to the opening direction 9, in this case inclined about 15° to the closing plane 6.

The cylindrical pressing region 24, which can be assigned to the press-on section 21 of the receiving part 1 from FIG. 1, likewise has three analogous segments with in each case corresponding, different radii of curvature, the centres of which here coincide with the centres of the radii of curvature of the toroidal pressing region 7. The third pressing region 25 is in the form of half a hexagon.

In contrast, the pressing region of a conventional, rigid press jaw of nominal diameter DN 18—e.g. a "press jaw 18, model No: 22992; Viega, Franz Viegner II, D-57428 Attendorn"—has a single constantly curved segment having a radius of curvature of 12.35 millimeters. In the rest state, the shape of such a pressing region is therefore already within the required shape tolerance of the outer shape of a pressed-on receiving part.

Figure 4:
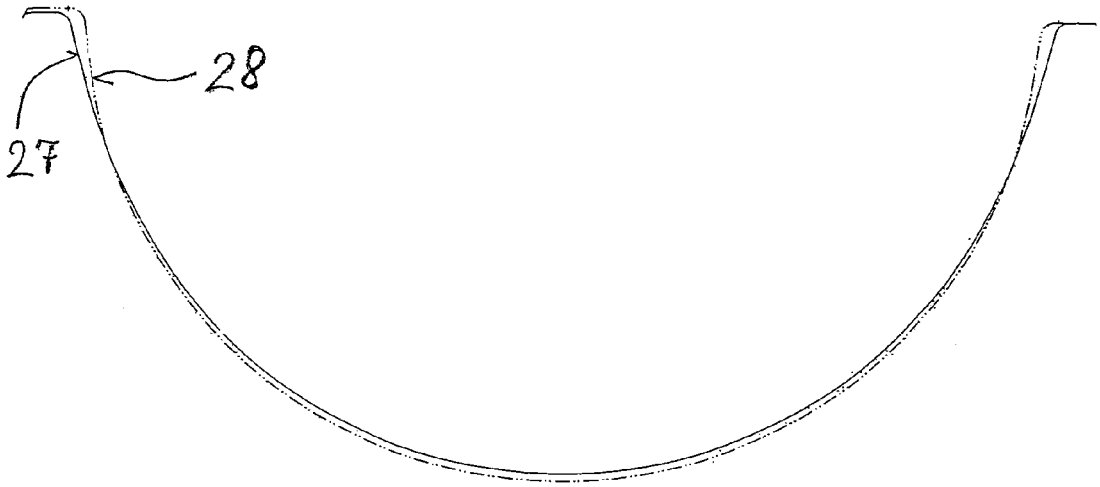

FIG. 4 shows a comparison to scale of the inner profile of the same press element in the rest state and in the pressed-on state of a closed press tool. A continuous line 27 represents the inner profile of the press element in the rest state with an exposed pressing region. A broken line 28 on the other hand represents the inner profile of the same press element in the pressed-on state of the closed tool. By means of such a press tool, a receiving part having a sealing section and a press-on section of a "Geopress fitting 20-63" of nominal diameter 50 can be pressed on within the same cylindrical tolerance. The pressing region of the press element in the pressed-on state of the closed tool rests against the sealing or press-on section, which is not shown in FIG. 4. In the pressing region, the broken line 28 has a substantially constant curvature which corresponds to the constant curvature of the required outer shape of the pressed-on sealing section or press-on section.

Between the two inner profiles, the maximum difference at the summit of the pressing region in the opening direction is slightly more than half a millimeter. This does not quite correspond to one percent of the nominal diameter of the compression joint. The difference between the internal diameters in the closing plane of the press tool has a value of slightly more than two millimeters, which corresponds to about 4 percent of the nominal diameter.

The invention claimed is:

1. Press tool for pressing a receiving part of a fitting onto a pipe inserted into the fitting, the pressed-on receiving part having a sealing section with an outer shape substantially constantly curved in a circumferential direction and within a predetermined shape tolerance, said press tool comprising:

two elastically-deformable press elements, each having:

a first end, a pressing region, assigned to the sealing section, having an inner shape that at least partially departs from a constant curvature in a circumferential direction, and a second end having a force input region and a stop surface; and a hinge coupling the press elements together at the first end of each press element, wherein when the press tool is closed, the stop surfaces of the press elements abut one another, and when the press tool is closed and a pressing force is applied to the force input regions of the press elements, the press elements elastically deform such that the inner shape of the pressing regions are substantially constantly curved in the circumferential direction.

2. Press tool according to claim 1, wherein, when the press tool is closed, an internal diameter in a direction perpendicular to a press tool closing plane is smaller than an internal diameter in a direction substantially parallel to the cress tool closing plane.

3. Press tool according to claim 2, wherein, the internal diameter in the direction perpendicular to the press tool closing plane has a smaller value than a diameter of the outer shape of the sealing section; and the internal diameter in the direction substantially parallel to the press tool closing plane has a greater value than the diameter of the outer shape of the sealing section.

4. Press tool according to claim 2, wherein the internal diameter in the direction perpendicular to the press tool closing plane has the smallest value.

5. Press tool according to claim 1, wherein the pressing region has a plurality of segments which are arranged in succession in the circumferential direction and which have constant curvatures differing from one another in each case in the circumferential direction and whose centers of curvature are a distance apart.

6. Press tool according to claim 5, wherein at least one of the plurality of segments is arranged closer to the centers of curvature than the outer shape of the sealing section.

7. Press tool according to claim 1, wherein at least one of the plurality of segments is arranged at least partly at a greater distance to the centers of curvature than the outer shape of the sealing section.

8. Press tool according to claim 1, wherein recesses which differ from the outer shape of the sealing section, and by means of which in each case an end region adjacent to the pressing region is formed, are provided in each press element.

9. Press tool according to claim 8, wherein that end of the end region which is opposite the pressing region is provided with a radius.

10. Press tool according to claim 1, wherein the hinge includes a single bearing pin.

11. Press tool according to claim 1, wherein the pressed-on receiving part has a further section, optionally within another specified shape tolerance, and each of the press elements has a further pressing region assigned to the further section.

* * * * *